US008453296B2

(12) United States Patent
Swerdlick

(10) Patent No.: US 8,453,296 B2
(45) Date of Patent: Jun. 4, 2013

(54) ERGONOMIC HANDLE SYSTEM FOR WORK TOOL

(76) Inventor: David Swerdlick, Plymouth, MN (US)

( * ) Notice: Subject to any disclaimer, the term of this patent is extended or adjusted under 35 U.S.C. 154(b) by 726 days.

(21) Appl. No.: 12/586,030

(22) Filed: Sep. 16, 2009

(65) Prior Publication Data

US 2010/0037424 A1 Feb. 18, 2010

Related U.S. Application Data

(63) Continuation-in-part of application No. 12/080,226, filed on Apr. 1, 2008.

(51) Int. Cl.
*A47L 9/00* (2006.01)

(52) U.S. Cl.
USPC ..... 15/410; 15/143.1; 15/145

(58) Field of Classification Search
USPC ..... 15/410, 430, 143.1, 144.2, 145, 228; 56/400.17, 400.18; 294/57, 58; 403/212, 403/248
See application file for complete search history.

(56) References Cited

U.S. PATENT DOCUMENTS

| | | | | |
|---|---|---|---|---|
| 3,097,890 | A * | 7/1963 | Doyle | 403/107 |
| 3,897,607 | A | 8/1975 | Schaffer et al. | |
| 4,009,908 | A * | 3/1977 | Alinder et al. | 299/37.1 |
| 4,435,870 | A * | 3/1984 | Tucker et al. | 15/98 |
| 5,507,071 | A | 4/1996 | Berfield | |
| 5,819,364 | A | 10/1998 | Sham | |
| 6,742,222 | B2 * | 6/2004 | Furr-Britt et al. | 16/430 |
| 7,216,403 | B2 | 5/2007 | Decker | |
| 7,761,955 | B1 * | 7/2010 | Hiltz | 15/322 |
| 8,082,619 | B1 * | 12/2011 | Willey | 15/144.3 |
| 2002/0124345 | A1 | 9/2002 | Holsten et al. | |
| 2002/0124347 | A1 | 9/2002 | Roney et al. | |
| 2003/0101534 | A1 | 6/2003 | Noreen et al. | |

* cited by examiner

*Primary Examiner* — Dung Van Nguyen

(74) *Attorney, Agent, or Firm* — Mark A. Litman & Associates, P.A.

(57) ABSTRACT

An ergonomically maneuverable vacuum cleaner has: a vacuum cleaner head moveable across a floor and a motor to create a vacuum on the vacuum cleaner head. There is a relatively upright single stem handle for gripping and moving of the vacuum cleaner with a single hand of a user. Releasably attached to the upright single stem handle is a dual grip handle positioned relatively perpendicular to the upright stem handle. The dual grip handle has a central handle bar that lies relatively horizontal to the floor when the vacuum cleaner is in use, and the handle bar having two cushion grips, one each on ends of the handle bar. There is a connecting element between the central handle bar and the upright single stem handle.

6 Claims, 5 Drawing Sheets

ERGONOMIC HANDLE SYSTEM FOR WORK TOOL

RELATED APPLICATIONS DATA

This application is a continuation-in-part of U.S. patent application Ser. No. 12/080,226, filed Apr. 1, 2008.

BACKGROUND OF THE INVENTION

1. Field of the Invention

The present invention relates to hand operated or hand powered apparatus in which users move and/or direct an active portion of the apparatus through a handle grasped and maneuvered by the user. In particular, the present invention relates to a handle system that can be grasped by both hands of the user in separate areas about a shaft.

2. Background of the Art

Appliances and hand tools tend to be used in specific modes and styles, even if the modes tend to be less than best from an ergonomic standpoint. Tension and repetitive stress tend to be placed on specific muscles, tendons and ligaments in a repeated manner because the design of the appliance or tool requires use in a particular way that places undesirable stress on specific portions of the human anatomy.

Numerous design and structural changes have been made in appliances and tools to address some of the stressful uses of those appliances and tools.

U.S. Pat. No. 7,216,403 (Decker) discloses an ergonomic appliance handle that is an extension handle attachable to a carrying or transport handle on a canister style vacuum cleaner or similar floor appliance. The ergonomic appliance handle provides an elongated handle shaft that is attached to the canister vacuum's handle at a proximate end of the handle shaft by a mounting assembly. The handle shaft extends angled upward, away from the vacuum, placing a handgrip at the distal end of the handle shaft at an ergonomically comfortable height and position for a user to easily and conveniently operate the vacuum in a comfortable posture without subjecting the user to unnecessary bending, stooping, or twisting.

U.S. Pat. No. 6,742,222 (Furr-Britt et al.) discloses a dual handle attachment for an upright floor appliance. A single central bracket attaches to the conventional single handlebar of an appliance, such as an upright vacuum cleaner, with a left and a right handgrip adjustably extending from the central bracket. The dual handle attachment allows a user to maneuver the appliance using generally symmetric upper body, arm, wrist, and hand forces.

U.S. Pat. No. 3,897,607 (Schaffer et al.) discloses a readily removable implement handle for a vacuum cleaner, tool, floor scrubber, sweeper, or other device. Insertion means disposed on the handle releasably engage with receiving means affixed to the device, the handle including a locking means in the form of a spring.

U.S. Pat. No. 5,507,071 (Berfield) discloses a U-shaped handle that is attachable to a motor housing of a vacuum apparatus to carry or lift the appliance.

U.S. Pat. No. 5,819,364 (Sham) discloses a detachable handle accessory for a handheld portable steam vacuum cleaner. The handle accessory includes a support base for mounting the portable steam vacuum cleaner, a handle portion extending upwardly from the support base, and a wheel assembly affixed to the support base. The handle converts the handheld portable steam vacuum cleaner into an upright steam vacuum cleaner.

U.S. Patent Application Publication 2002/0124347 (Roney et al.) discloses a telescoping handle built into an upright vacuum cleaner.

U.S. Patent Application Publication No. 2002/0124345 (Holsten et al.) discloses a vacuum appliance having push and pull handles. The vacuum cleaning appliance is generally of the canister vacuum configuration. A first handle is disposed on a first side of the vacuum appliance, a second handle being disposed on a second side of the vacuum appliance generally opposite the first side.

U.S. Patent Application Publication 2003/0101534 (Noreen et al.) discloses a canister-type vacuum cleaner having a collapsible handle attached to the housing that is adjustable to the height of a user and positioned so that the user can use the handle to move and guide the vacuum cleaner housing.

Additional improvements are needed in ergonomic designs for hand operated appliances and tools, and add-on appliance handling systems are also desired.

SUMMARY OF THE INVENTION

A handle attachment is provided for addition to existing apparatus or appliance with push handles on them. The attachment provides two handles (one left hand and one right hand) for use by an appliance operator. The attachment will have at least two regions of securement to the existing push handle on the appliance or apparatus, one region relatively proximal to the user along the existing push handle and the other region more distal from the user and the two regions being on opposite sides of the handles added by the attachment. The handles in the attachment may also fold during storage.

An attachment is used with an appliance having a single shaft for gripping and manipulation of the appliance by a user. The attachment has a base having a first end and a second end, and a first side and a second side. On the base are two shaft-securing elements. There are a first shaft-securing element positioned towards the first end and a second shaft-securing element positioned towards the second end. There is a two-hand grip handle attached to the base intermediate the first shaft securing element and the second shaft-securing element.

DETAILED DESCRIPTION OF THE INVENTION

A handle attachment is provided for tools or appliances, such as by way of non-limiting examples, vacuum cleaners, floor washers, floor waxers, mops, electric mops, sanders, floor polishers, floor sanders, and the like. The previous appliances (the term appliances is used herein to cover all such appliances and tools and devices as can be envisioned for use in combination with the invention described herein) and the appliances of choice to which the attachment is preferably provided typically have a stem, post or elongated handle with a single hand grip thereon. The attachment described herein is associated with and secured to the handle of the standard or prior art appliance, and the handle attachment can then be held by two hands to allow the user to control, move, direct and manipulate the device with two relatively symmetrical applications of force through two hands, rather than placing all usage stress on a single hand.

An attachment is used with an appliance having a single shaft for gripping and manipulation of the appliance by a user. The attachment has a base having a first end and a second end, and a first side and a second side. On the base are two shaft-securing elements. There are a first shaft-securing element positioned towards the first end and a second shaft-securing element positioned towards the second end. There is a two-hand grip handle attached to the base intermediate the first shaft securing element and the second shaft-securing element. The attachment may have:

a) the two-hand grip handle with a freedom of rotation about its axis;

b) each of the two shaft-securing elements comprising a support on the base and a strap passing through the support;

c) there is a locking element on the strap;

d) the base is flexible to enable adjustment to single shafts of different sizes;

e) the base is linear between the first end and the second end;

f) a slice through the base between the first end and the second end provides an arcuate cross-section; and g) the two-hand grip is adjustable on the base in a direction between the first end and the second end.

The application of the present device to a vacuum cleaner will be discussed in greatest detail, and this discussion must be considered as a single device/appliance example within the generic scope of use of the present invention and not as a general limitation on the field of practice for the invention.

Looking at the Figures will assist in appreciating and understanding the practices of the technology and invention described herein.

Figure 3:
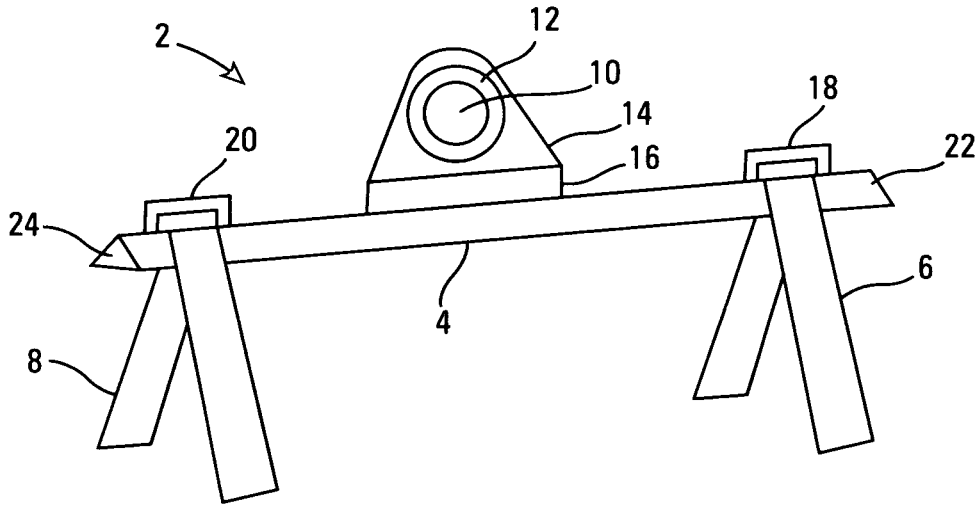
FIG. 3 shows a side view of an ergonomic handle attachment for a single hand manipulated appliance or tool.

FIG. 3 shows a side view of an ergonomic handle attachment 2 for a single hand manipulated appliance or tool. The attachment 2 has a base 4 and an upper end 22 on the base 4 and a lower end 24 on the base 4. These "ends" may be interchangeable and the device symmetrical. On the upper end 22 is an attachment/securing system 18 shown as a strap guide and a strap 6. The strap 6 may have clips, snaps, fabric locks (e.g., Velcro® fasteners), buckles snake locks and the like to tighten the strap 6 and secure the base 4 to a handle on an appliance. On the lower end 24 is an attachment/securing system 20 shown as a strap guide and a strap 8. The base 4 may be rigid, linear and shaped (e.g., one face is arcuate) to accommodate a traditional straight handle (e.g., broom stick), or the base 4 may be uniquely shaped (sinusoidal, curved, angled, etc.) to fit a specific appliance handle, or the base 4 may be sufficiently flexible as to accommodate different shapes and sizes of handles on various appliance and handles on the appliances of different sizes and shapes.

Figure 1:
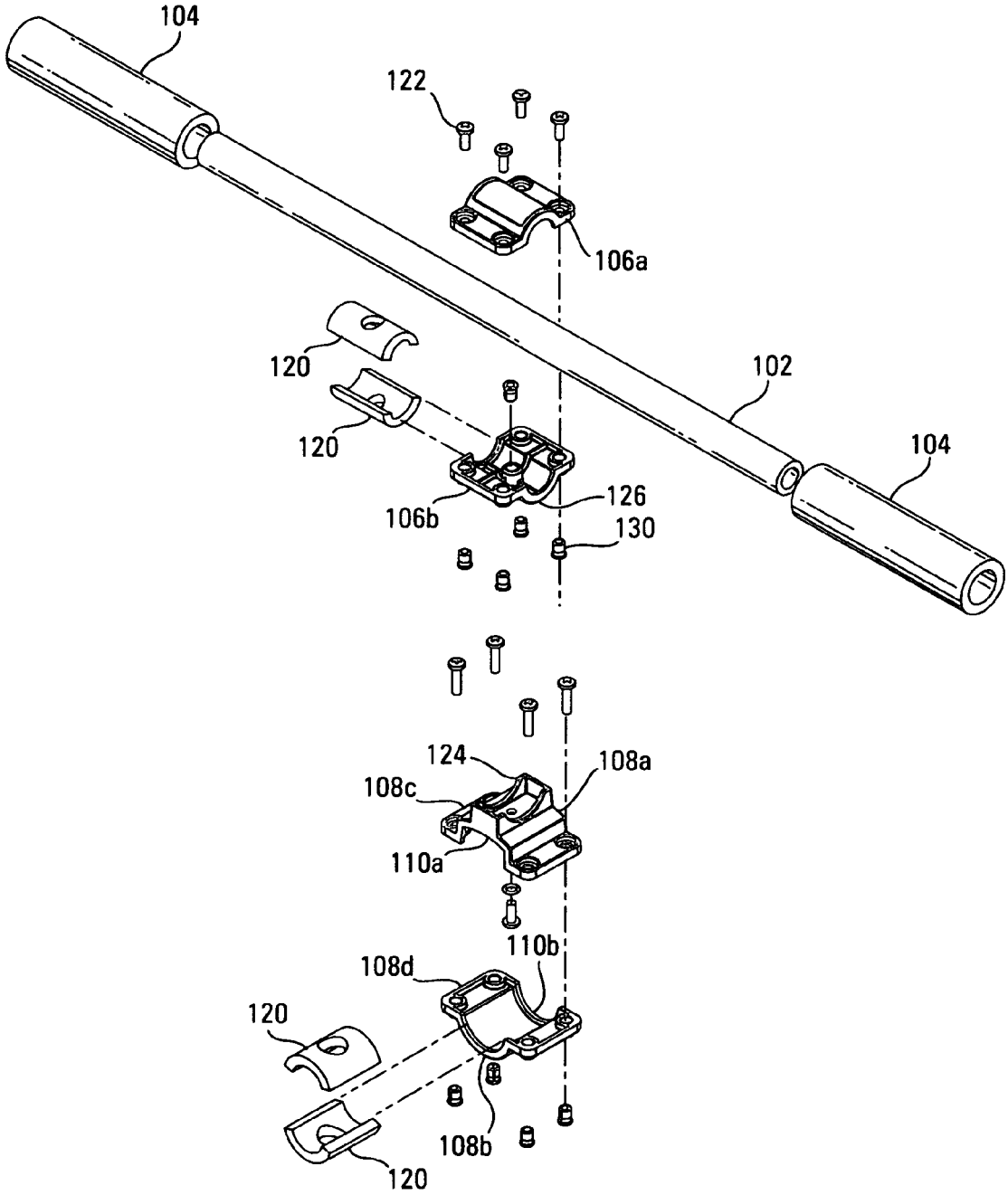
FIG. 1 shows an exploded view of one embodiment of novel dual handle technology described herein.
Figure 2:
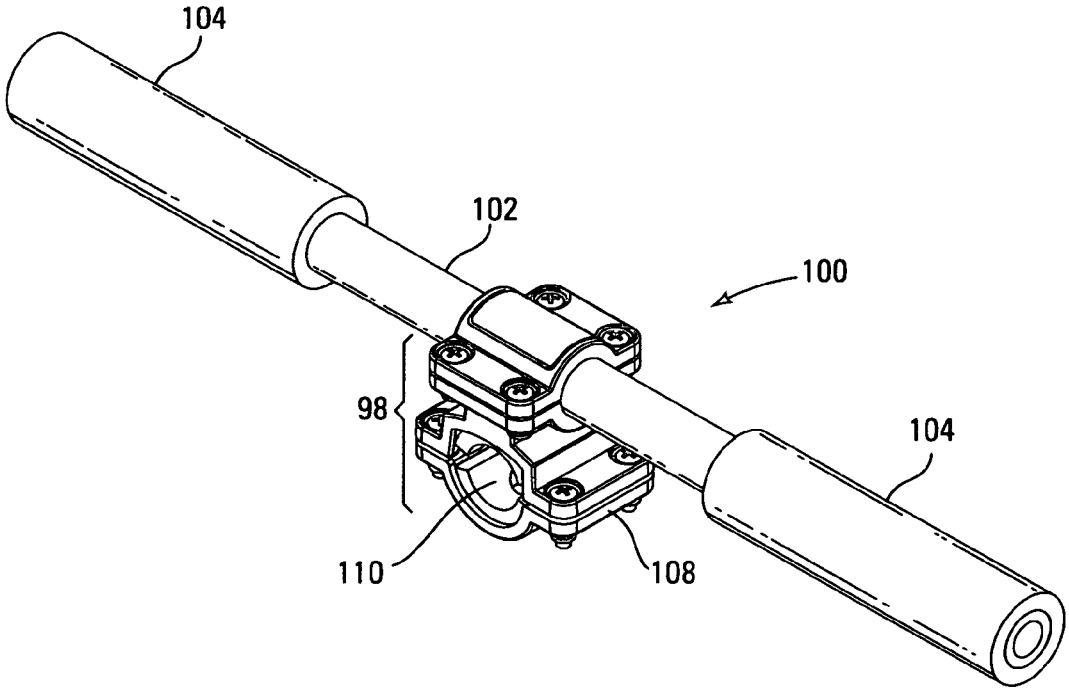
FIG. 2 shows a perspective view of one embodiment of novel dual handle technology described herein.

FIG. 2 shows a top view of an ergonomic handle attachment 2 for a single hand manipulated appliance or tool. Like numbers in the Figures refer to like elements in all figures. As seen from this top view, the straps 6 and 8 are towards opposite ends 22 and 24 of the base 4. The base 4 may be flexible (but stiff enough to resist distortion and slipping off a handle to which it is attached) and may be made of metal, wood, plastic, composite and the like. The attachment systems 18 and 20 may be permanently on the base 4 or may be replaceable with snaps, screws or the like. The attachment 2 handle 10 may be secured through a collar, brace or sleeve 12 and a pin or handle securing element 30 that passes into or through at least the collar 12 and optional longitudinal support 26 to assist in stabilizing the attachment 2 and optionally providing horizontal adjusting capability along glide 36 and vertical adjustability along glide 34, the optional glide 34 being in vertical track 32 and the optional horizontal glide 36 being in the collar 12. The handle 10 is shown with a capability of two-way rotation A so that when users are manipulating the appliance with the handle 10, the handle 10 can rotate to further reduce stress on the hands, wrist and arms of the user. The position of the handle 10 on the base 4 may be adjusted forward and sideways through the grooves 34 and 36. The handle 10 may also be allowed (as an option) to pivot about the securing element 30. The optional longitudinal support 26 may also rotate clockwise or counterclockwise as illustrated in rotation illustration B.

Figure 4:
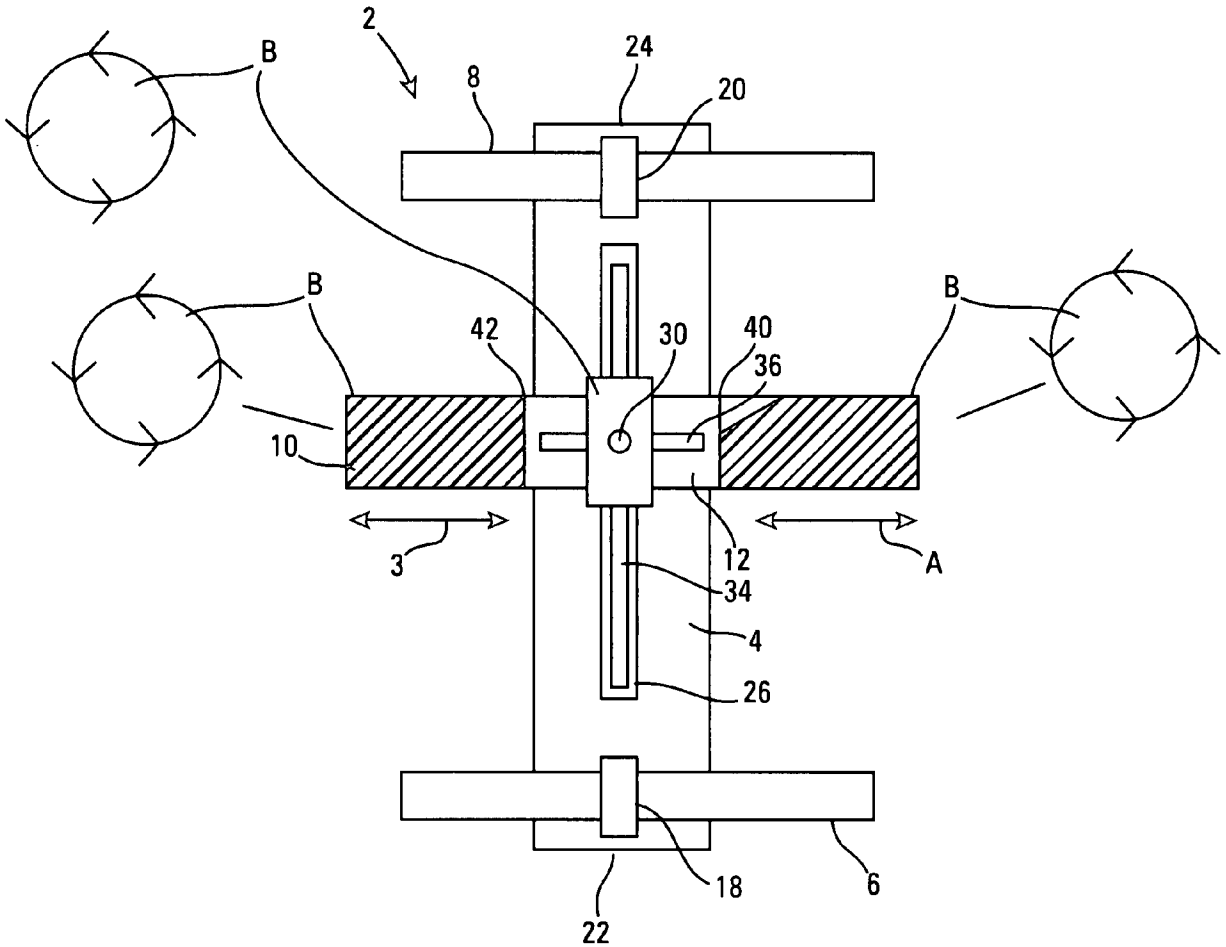
FIG. 4 shows a top view of an ergonomic handle attachment for a single hand manipulated appliance or tool.

Another option in the construction of the attachment is shown in FIG. 4. Pockets or chambers 44 and 46 are shown in the base 4 (or they may alternatively be in the shaft (not shown) of the appliance (not shown) for receiving the ends of the handle 10 as it is folded along lines 40 and 42 with hinges or other moving connectors.

The attachment 2 as described herein may be used on any device or appliance where there is presently a single handle used to control or push the device. The most readily acceptable use is on a vacuum cleaner. In the normal use of a vacuum cleaner, there is a single shaft with a single grip for use by a single hand. Any attempt to use two hands would require a baseball or golf grip with hands at different levels on the shaft (thereby putting the arms and shoulders of the user out of alignment) or by having the hands on top of each other, which is an ineffective working position. The present technology allows for immediate and simple conversion of existing equipment to a two-hand system, with relatively parallel or symmetrical application of force by the user. In practice, the user will still place one foot in front of the other to advance the vacuum cleaner, but the shoulders and arms may remain somewhat symmetrical, and by allowing some pivoting and/or rotational action in the handles (as explained above), stress will be reduced.

An alternative structure according to the present technology includes a device for improving the ergonomics and control on a vacuum cleaner by the addition of a dual handle grip to a single stem handle on a vacuum cleaner. As has been described, vacuum cleaners and their handles have traditionally been only single stem handles rising from the vacuum cleaner body to a single hand grip. The stem or pipe or post is typically a cylindrical pole. The present alternative technology allows for an attachment to be added and removed from that single stem to improve the ergonomics and control of the vacuum cleaner.

According to this technology a dual handle grip is provided with a securing element approximately centered between the two hand grips. The securing element surrounds and conforms to the single stem. The securing may be done by any element that can engage the single stem by sliding down the stem and tightened or slipped perpendicularly to the stem and then tightened. For example, a composite securing element may be first attached to the handle with second single stem securing component that can be secured to the single stem to hold the securing element and the dual grip handle to the single stem. For example, the second stem securing element may hinge at one side and then clip on the other side to allow the second stem securing element to be slipped over the single stem, the hinge swung closed, and the distal end (away from the hinge) is then locked shut (e.g., by screws, clips, snaps, bolts or other physical locking mechanisms). In another example, one face on the second stem securing element may be fixed or first secured to the element on the dual handle. The one face may be positioned on the single stem of the vacuum cleaner and a second opposing face of the second stem securing element positioned over an opposed side of the single stem and then secured to the one face of the second stem securing element (e.g., by screws, clips, snaps, bolts or other physical locking mechanisms). Additional closing and locking mechanisms contemplated in the scope of the present technology for closing and locking the stem securing element (e.g., the second stem securing element that attaches directly to the relatively upright vacuum cleaner single stem handle) could include a ratcheting system where a lever is motivated repeatedly to close and tighten closure of the stem securing element. Another alternative contemplated is a "snake" closing and securing mechanism in which a threaded screw or bolt is used to progress a coil or flat metal strip to close tightly about the stem or to bring the second pair of opposed elements together into a locked and tight gripping action on the relatively upright vacuum cleaner single stem handle.

The method of using the technology of the present invention may be described generally and then specifically as follows. A single, relatively upright grip stem vacuum cleaner is made ergonomically acceptable by positioning a dual grip handle system adjacent to the grip stem, positioning the dual grip handle relatively perpendicularly to the single stem and horizontally with respect to a plane on the vacuum head that would be parallel to a surface to be vacuumed (e.g., the floor), and securing the dual grip handle system to the single stem so that the dual grip handle is relatively perpendicular to the single stem.

Reference to the Figures will assist in appreciation of this alternative structure or the present technology. The central handle for the dual handle grip 102 has two grips 104 on opposed ends. The device 98 attaching the dual handle attachment to the single stem of the vacuum cleaner comprises dual handle gripping attachment 106 which is in turn attached to the vacuum cleaner single stem gripping attachment 108. The single stem gripping element 108 provides an opening 110 into which is secured the single stem of the vacuum cleaner handle.

The dual handle gripping attachment 106 is shown as constructed of a top element 106*a* and a bottom element 106*b*. The bottom element 106*b* has a rounded bottom surface 126 that nests in the nesting receiver 124 on a top component 108*a* of the single stem gripping attachment 108. Alternatively, bottom element 106*b* and top component 108*a* may be molded as single piece. Foam cushions 120 may be provided within opening 110 and between elements 106*a* and 106*b* to assist in conforming the gripping attachments 106 and 108 to their respective posts or stems. Bolts 122 and nuts 130 are shown as securing the gripping elements 106 and 108, but other locking or securing elements may be used. Alternatively, the single stem gripping component 108*c* may be locked with hinges (not shown) on edges 108*d* and then locked with physical locking elements on the opposed edges on elements 108*a* and 108*b*. The element 106 may be molded onto the handle 102 or in a less preferred embodiment may be eliminated completely by attaching an element such as 108*a* directly to the handle 102. The nesting curvature 124 may nest against the handle post 102 to provide a more secure attachment. A bolt or other locking element (not shown) may pass through the single stem engaging element 108*a* and into or through the handle post 102.

Figure 5:
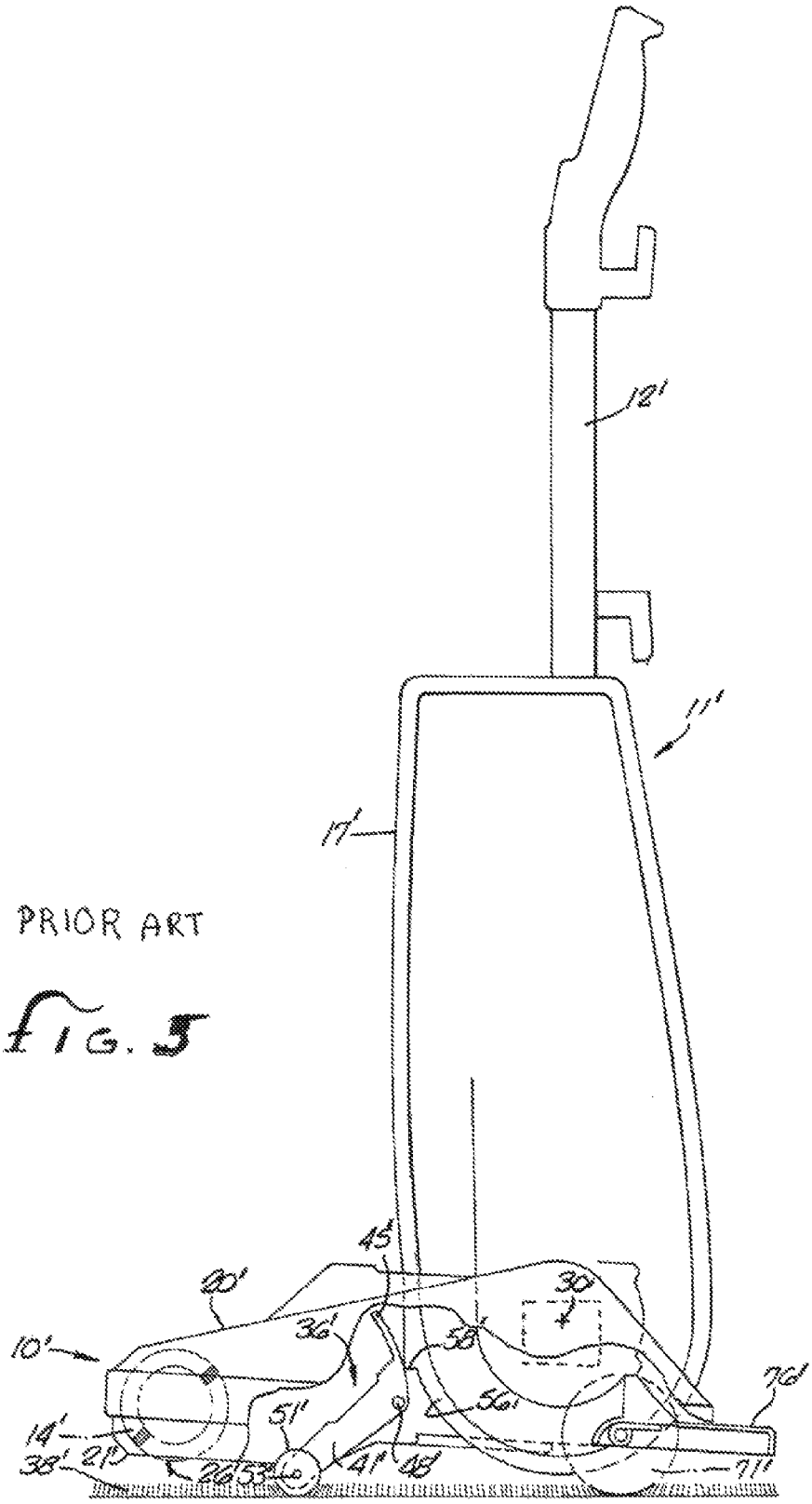
PRIOR ART FIG. 5
FIG. 5 shows a side cutaway view of a vacuum cleaner of the Prior Art.

FIG. 5 shows a side cutaway view of a vacuum cleaner 11' of the Prior Art. Shown are conventional elements of vacuum cleaners of the prior art, handle 12', body 17', motor 30', vacuum head 20', front of the vacuum head 10', wheels 14', 26' and 71', various structural elements inessential to the present invention 21', 36', 45', 58', 56', 76', 53' and 48' and a carpet 38'.

The technology described herein may be further described as a method for improving the ergonomic handling ability of a vacuum cleaner having a single upright stem. The improved ergonomics are provided by converting a single upright stem handle vacuum cleaner into a dual grip handle system, with the dual grip handle being attached relatively perpendicular to the single upright stem (and it mat be rotatable from that perpendicular position) so that the handle may also lie in a line that can be parallel to flooring that is to be vacuumed. The process may include:

a) providing an attachable dual handle system with a handle having two opposed grip ends and a single handle engaging element secured (approximately in the center of the handle) to the handle; and b) securing the single handle engaging element to a single stem handle of a vacuum cleaner so that the handle with two opposed grip ends is approximately perpendicular to the single stem handle.

The single handle engaging element may consist of two opposed components, a first component nesting on the handle and forming an opening with the second component that encloses the single stem handle. The single handle engaging element alternatively may consist of two pairs of opposed components, a first pair of opposed components secured entirely around the dual handle and the second pair of opposed components nesting on one component of the of the two components of the first pair of opposed components. The handle may be secured to the first pair of opposed components, and the first pair of opposed components is secured to the second pair of opposed components, a first component of the second pair of opposed components forming an opening with the second component of the opposed pair of opposed components that encloses the single stem handle. In the construction and performance of the process, an opening formed by the first pair of opposed components may be perpendicular to an opening formed by the second pair of opposed components. The first pair of opposed components may be secured about the dual handle, the secured pair of opposed components is then attached to at least one component of the second pair of opposed components, and the second component of the second pair of opposed components is secured to the first component of the second pair of opposed components while the second pair of opposed components is positioned about a single handle of a vacuum cleaner.

The process forms an ergonomically maneuverable vacuum cleaner having:

a) a vacuum cleaner head moveable across a floor and a motor to create a vacuum on the vacuum cleaner head;

b) a relatively upright single stem handle for gripping and moving of the vacuum cleaner with a single hand of a user;

c) releasably attached to the upright single stem handle is a dual grip handle positioned relatively perpendicular to the upright stem handle;

d) the dual grip handle having a central handle bar that lies relatively horizontal to the floor when the vacuum cleaner is in use, and the handle bar having two cushion grips, one each on ends of the handle bar;

e) a connecting element between the central handle bar and the upright single stem handle, the connecting element being releasably attached to the central handle bar at a first end and releasably attached to the upright single stem handle at a second end; and f) the second end of the connecting element fully surrounding the upright single stem handle with a force that prevent movement of the dual grip handle when 25 kg force is applied on two handles of the dual grip handle in a direction parallel to the upright single stem handle.

What is claimed:

1. An ergonomically maneuverable vacuum cleaner comprising: a) a vacuum cleaner head moveable across a floor and a motor to create a vacuum on the vacuum cleaner head; b) a relatively upright single stem handle for gripping and moving of the vacuum cleaner with a single hand of a user; c) releasably attached to the upright single stem handle is a dual grip handle positioned relatively perpendicular to the upright stem handle; d) the dual grip handle having a central handle bar that lies relatively horizontal to the floor when the vacuum cleaner is in use, and the handle bar having two cushion grips, one each on ends of the handle bar; e) a connecting element between the central handle bar and the upright single stem handle, the connecting element being releasably attached to the central handle bar at a first end and releasably attached to the upright single stem handle at a second end; and f) the second end of the connecting element fully surrounding the upright single stem handle with a force that prevent movement of the dual grip handle when 25 kg force is applied on two handles of the dual grip handle in a direction parallel to the upright single stem handle.

2. The vacuum cleaner of claim 1 wherein the handle bar attached to the upright single stem handle consists of two opposed components, a first component nesting on the upright single stem handle and forming an opening with the second component that encloses the upright single stem handle.

3. The vacuum cleaner of claim 1 wherein the handle bar attached to the upright single stem handle consists of two pairs of opposed components, a first pair of opposed components secured entirely around the dual grip handle and the second pair of opposed components nesting on one component of the two components of the first pair of opposed components.

4. The vacuum cleaner of claim 2 wherein the upright single stem handle is secured to the first pair of opposed components, and the first pair of opposed components is secured to the second pair of opposed components, and a first component of the second pair of opposed components forming an opening with the second component of the opposed pair of components that encloses the upright single stem handle.

5. The vacuum cleaner of claim 2 wherein an opening formed by the first pair of opposed components is perpendicular to an opening formed by the second pair of opposed components.

6. The vacuum cleaner of claim 4 wherein the first pair of opposed components is secured about the dual grip handle, the secured pair of opposed components is attached to at least one component of the second pair of opposed components, and the second pair of opposed components is secured to the first component of the second pair of opposed components while the second pair of opposed components is positioned about a single handle of a vacuum cleaner.

* * * * *